United States Patent [19]

Witt et al.

[11] Patent Number: 4,640,194

[45] Date of Patent: Feb. 3, 1987

[54] AIRBORNE ARRANGEMENT FOR PRODUCING A PROJECTILE

[75] Inventors: Wolfram Witt, Duesseldorf; Herbert Scholles, Meerbusch, both of Fed. Rep. of Germany

[73] Assignee: Rheinmetall GmbH, Duesseldorf, Fed. Rep. of Germany

[21] Appl. No.: 676,661

[22] Filed: Nov. 30, 1984

[30] Foreign Application Priority Data

Nov. 30, 1983 [DE] Fed. Rep. of Germany ..... 3343267

[51] Int. Cl.[4] ..... F42B 25/20; F42B 25/08; F42B 1/02; F42C 13/04

[52] U.S. Cl. ..... 102/425; 102/397; 102/476; 102/214

[58] Field of Search ..... 102/393, 214, 397, 476, 102/425; 422/165, 166

[56] References Cited

U.S. PATENT DOCUMENTS

| | | | |
|---|---|---|---|
| 656,934 | 8/1900 | Brown | 244/3.3 |
| 3,116,691 | 1/1964 | Tatel et al. | 102/214 |
| 3,578,415 | 5/1971 | Hiltz | 422/166 |
| 3,710,716 | 1/1973 | Davis et al. | 102/397 |
| 3,875,862 | 4/1975 | Fischer et al. | 102/427 |
| 4,050,381 | 9/1977 | Heinemann . | |
| 4,455,943 | 6/1984 | Pinson | 102/393 |

FOREIGN PATENT DOCUMENTS

| | | |
|---|---|---|
| 2207557 | 11/1973 | Fed. Rep. of Germany . |
| 2831378 | 1/1980 | Fed. Rep. of Germany . |
| 3137198 | 4/1983 | Fed. Rep. of Germany . |
| 8005542 | 3/1980 | France . |
| 1444029 | 7/1976 | United Kingdom . |

*Primary Examiner*—Deborah L. Kyle
*Assistant Examiner*—Michael J. Carone

[57] ABSTRACT

The invention relates to a mine or drop bomb having an effective load, a shaped charge, and an antenna which encompasses a target recognition device. In order to achieve on the one hand a rugged, arrangement which can withstand high acceleration forces, and, on the other hand, provide an optimum functioning of the antenna, the antenna is axially outwardly slidable, so that it can move from an inoperative, respectively transport, position into an operative position. For this purpose the antenna is mounted on a plurality of columns, which are equi-angularly disposed about the periphery of the arrangement and are slidable within guide means disposed in the housing of the arrangement. The antenna may be deployed by an inflatable gaseous container. In one embodiment the container may comprise an explosive gaseous mixture which ignites to break-off the antenna from the device before the mine explodes.

4 Claims, 4 Drawing Figures

AIRBORNE ARRANGEMENT FOR PRODUCING A PROJECTILE

BACKGROUND OF THE INVENTION

Airborne arrangements for producing projectiles generally are brought over a target region by means of airborne transport means and are expelled from such means and thereafter seek automatically the target for purposes of combatting it. There is disclosed in U.S. Pat. No. 3,875,862 a hollow charge-mine for multiple deployment which descends while being suspended from a parachute and which has a sensor system mounted therein within a frontally arranged elastic dome.

SUMMARY OF THE INVENTION

It is an object of this invention, to provide an arrangement of the afore-described type, which is more compact during storage and transport and has relatively reduced spatial requirements. This novel arrangement is particularly resistant to acceleration forces in its flight-phase and can nevertheless provide optimal functioning of the sensor and other operative parts.

BRIEF DESCRIPTION OF THE DRAWINGS

With these and other objects in view, which will become apparent in the following detailed description, the present invention will be clearly understood, in connection with the accompanying drawings, in which.

DETAILED DESCRIPTION

In arrangements of the afore-described type a large number of operational requirements must be met, which requirements are to some extent mutually contradictory. For example, the arrangement should be, on the one hand, very compact, in view of the fact that it must be mounted with many other arrangements of the same type in a transport device and must withstand during transport very high acceleration forces; on the other hand, it is necessary for an optimum target sensing to provide an antenna forming part of a target recognition device which must operate optimally, and finally a projectile is to be produced by means of a coaction of the effective load with the projectile-forming layer after target recognition, whereby the so-formed projectile must function undisturbed by the structure of the antenna.

Figure 1:
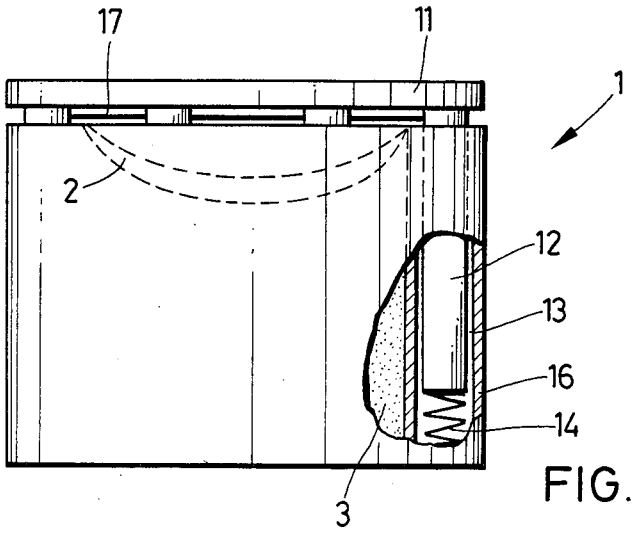
FIG. 1 is an elevational view, partially in cross-section, of an arrangement of this invention having an antenna disposed in its transport position.
Figure 2:
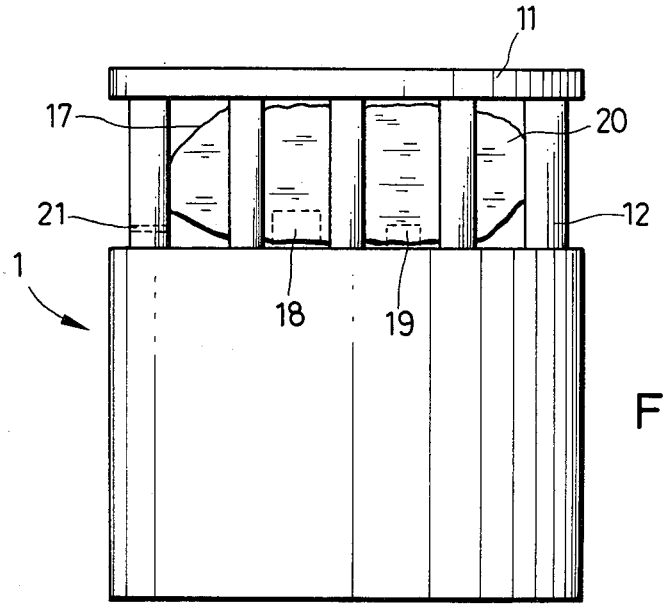
FIG. 2 is a side-elevational view of the arrangement wherein the antenna is disposed in an operative position.

A compact, space-saving and acceleration-resistant arrangement is achieved by means of the device illustrated in FIG. 1, in that the antenna 11 is adapted to be pushed outwardly in an axial direction. For this purpose there is provided in the arrangement 1 a housing 16 which includes guide means 13. These guide means are preferably in the form of guide cylinders which are disposed preferably uniformly about the periphery of the arrangement 1. Support columns 12 are slidably mounted within these guide cylinders 13. These support columns 12 support the antenna proper 11. By outwardly gliding the columns 12, the antenna 11 is moved from an inoperative (transport position as illustrated in FIG. 1) to an operative position (illustrated in FIG. 2), in which it is optimally adapted to operate. There is disposed within the housing 16 of the arrangement 1 an effective charge 3, which can be brought to detonation at an optimum distance from the target and which includes a projectile-forming layer 2 which is converted into a suitable projectile for combatting the target. During storage time and the transport phase the arrangement 1 assumes the configuration as illustrated in FIG. 1, that is the antenna 11 is retracted. In this manner a very rugged construction is obtained, which can withstand the high acceleration forces during the flight and expulsion phase of the unit. After the expulsion of the unit over a target region the antenna 11 is slid outwardly to assume the operative position. To achieve this outward sliding there are provided within the guide means 13 precompressed spring elements 14 (FIG. 1), which are first of all secured, and after their release, push the columns 12 out of the guide means 13 and thereby slide the antenna 11 into the operative position.

Figure 4:
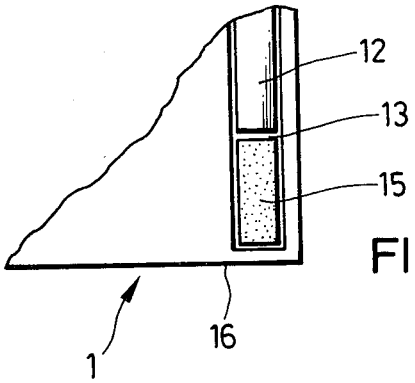
FIG. 4 is an enlarged sectional view of a further embodiment of the invention.

In a further embodiment of the invention (FIG. 4) the spring elements 14 are replaced by pyrotechnical charges 15, which are ignited at an appropriate point in time, thereby forming a gas pressure within the guide means 13, which again push outwardly the columns 12 and the antenna 11 to thereby move it into an operative position.

In a further embodiment of the invention there is provided, for expelling or slidably moving the antenna 11 into an operative position, an inflatable container 17 containing a gaseous medium, which is disposed between the antenna 11 and the housing 16 of the arrangement 1. In the inoperative position (FIG. 1) the container 17 is in a folded position. This container 17, which can, for example be an inflatable container of synthetic material, coacts with a gas generator 18, which after activation fills the container with a gaseous medium, and thereby lifts the antenna 11 into its operative position. It is, of course, possible to provide in addition to the container 17 simultaneously also the afore-mentioned spring elements 14 and/or the pyrotechnical charges 15 for expelling or sliding outwardly the antenna 11.

Since the antenna 11, as viewed from the direction of flight, is arranged in front of all the other constructional elements of the arrangement 1, it can fulfill its operational function optimally, since no blockage of electromagnetic waves occurs and the antenna can evaluate the electromagnetic radiation received from the target region in an undisturbed manner. While this arrangement of the antenna is optimum for the operation of the target recognition device, it does disturb, however, in particular with a massive construction of the antenna 11, the flight path of the projectile. Such projectile is produced from the projectile-forming layer 2 after detonation of the effective charge 3. In order to remove this hindrance, it has been found advantageous, to remove the antenna 11 from a position in front of the projectile-forming charge 2, after a target has been recognized in a target recognition device and the therewith coacting antenna 11 have fulfilled their operative function.

Figure 3:
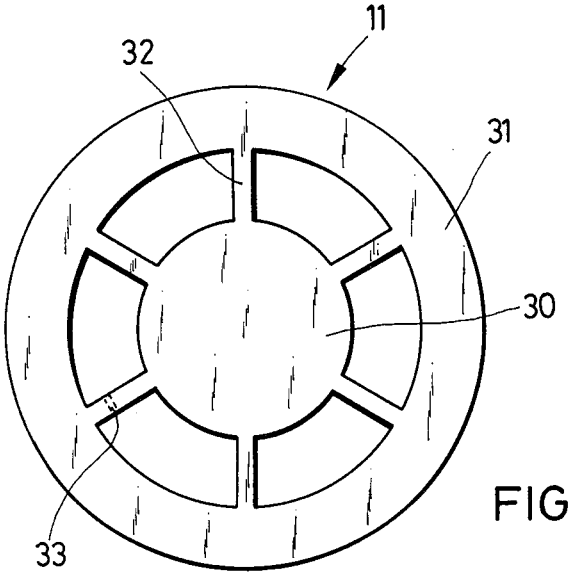
FIG. 3 is a plan view of the top surface of the antenna in accordance with the arrangement of this invention.

A breaking-off of the antenna 11 by means of the container 17 can be achieved, in that the latter is filled by the gas generator 18 with an explosive gaseous mixture 20, for example ethylene oxide/oxygen, acetylene/oxygen or hydrogen/oxygen, which first expands the container 17 and thereby slidably moves outwardly the antenna 11 into its operative position, which, however, thereafter at the point of time of breaking-off the antenna is brought to a detonation by means of an ignition arrangement 19. In this way the container 17 is destroyed and the antenna 11 is severed from the remaining housing 16 of the arrangement 1. In order to facilitate this breaking-off or severing, there are provided at the columns 2 (FIG. 2) break zones 21. For purposes of weight-saving the antenna 11 is made out of an outer ring 31 (FIG. 3), which is supported by the columns 12, and a central antenna-surface 30, which is joined to the outer ring 31 by means of the struts 32. In order to facilitate a severing or breaking-off of the antenna-parts, in particular the central antenna surface 30, these struts 32 are also advantageously provided with breaking zones 33.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved airborne arrangement for producing a projectile having an effective load, a projectile-forming layer and a target-recognition device which encompasses an antenna, the improvement comprising said arrangement including a housing having a longitudinal axis;

said antenna being outwardly axially slidably mounted in said housing; and means supporting said antenna, said support means being equi-angularly disposed about the periphery of said housing, guide means in said housing, said support means being slidably mounted in said guide means, whereby said antenna is movable from an inoperative position to an operative position by outwardly sliding said support means in said guide means, wherein, an inflatable container is mounted between said housing and said antenna, which said container is adapted to be inflated by a gaseous mixture coming from an internal pressure source.

2. The improvement in an airborne arrangement as set forth in claim 1, including means supporting said antenna, said support means being equi-angularly disposed about the periphery of said housing, guide means in said housing, said support means being slidably mounted in said guide means, whereby said antenna is movable from an inoperative position to an operative position by outwardly sliding said support means in said guide means.

3. The improvement as set forth in claim 1, wherein the said internal pressure source is a gas generator operatively connected to said container for inflating said container with an explosive gaseous mixture.

4. The improvement as set forth in claim 3, including an ignition means operatively mounted in said container for selectively igniting said explosive gaseous mixture in said container.

* * * * *